US010376123B2

(12) United States Patent
Luo et al.

(10) Patent No.: US 10,376,123 B2
(45) Date of Patent: Aug. 13, 2019

(54) SURFACE CLEANING APPARATUS

(71) Applicant: BISSELL Homecare, Inc., Grand Rapids, MI (US)

(72) Inventors: Ming Luo, Shenzhen (CN); Wing-Hei Cho, Hong Kong (CN); Jeffrey A. Scholten, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 235 days.

(21) Appl. No.: 15/461,798

(22) Filed: Mar. 17, 2017

(65) Prior Publication Data

US 2017/0188775 A1 Jul. 6, 2017

Related U.S. Application Data

(63) Continuation of application No. 14/105,290, filed on Dec. 13, 2013, now Pat. No. 9,635,991.

(60) Provisional application No. 61/738,645, filed on Dec. 18, 2012.

(51) Int. Cl.
*A47L 11/40* (2006.01)
*A47L 13/22* (2006.01)

(52) U.S. Cl.
CPC ..... *A47L 11/4086* (2013.01); *A47L 13/225* (2013.01)

(58) Field of Classification Search
CPC ..... A47L 13/225; A47L 11/4086; A47L 11/4083; A47L 11/4088
See application file for complete search history.

(56) References Cited

U.S. PATENT DOCUMENTS

| | | | | |
|---|---|---|---|---|
| 2,246,111 | A | 6/1941 | Snyder | |
| 2,279,320 | A * | 4/1942 | Huston | A47L 23/05 401/186 |
| 2,986,764 | A | 6/1961 | Krammes | |
| 3,040,362 | A | 6/1962 | Krammes | |
| 3,871,051 | A * | 3/1975 | Collier | A47L 9/0411 15/321 |
| 5,497,809 | A | 3/1996 | Wolf | |
| 5,894,042 | A * | 4/1999 | Ferralli | B05D 7/02 138/145 |
| 5,933,912 | A | 8/1999 | Karr et al. | |
| 6,015,097 | A | 1/2000 | VanPutten | |
| 6,082,376 | A | 7/2000 | Karr et al. | |
| 6,832,409 | B2 | 12/2004 | Morgan et al. | |
| 7,954,200 | B2 | 6/2011 | Leonatti et al. | |
| 2004/0221407 | A1 | 11/2004 | Field et al. | |

FOREIGN PATENT DOCUMENTS

| | | |
|---|---|---|
| CN | 102743134 A | 10/2012 |
| CN | 102743135 A | 10/2012 |

OTHER PUBLICATIONS

Rhodri Evans, Patents Act 1977: Search Report Under Section 17(5), dated Apr. 22, 2014, 3 pages, South Wales.

* cited by examiner

*Primary Examiner* — Andrew A Horton
(74) *Attorney, Agent, or Firm* — McGarry Bair PC

(57) ABSTRACT

A surface cleaning apparatus comprises a supply tank and a distributor for delivering fluid to a surface to be cleaned. A constant flow of fluid can be delivered from the supply tank to the distributor via a regulator tank in fluid communication with the supply tank for exchanging liquid and air with the supply tank.

16 Claims, 7 Drawing Sheets

SURFACE CLEANING APPARATUS

CROSS-REFERENCE TO RELATED APPLICATION(S)

This application is a continuation of U.S. patent application Ser. No. 14/105,290, filed Dec. 13, 2013, now U.S. Pat. No. 9,635,991, issued May 2, 2017, which claims the benefit of U.S. Provisional Patent Application No. 61/738,645, filed Dec. 18, 2012, both of which are incorporated herein by reference in their entirety.

BACKGROUND OF THE INVENTION

Surface cleaning apparatuses which dispense fluid, such as steam mops, hand-held steamers, liquid mops, and hand-held liquid dispensers are configured for cleaning a wide variety of common household surfaces such as bare flooring, including tile, hardwood, laminate, vinyl, and linoleum, as well as carpets, rugs, countertops, stove tops and the like. Typically, steam mops have at least one liquid tank or reservoir for storing a liquid, generally water, which is fluidly connected to a steam generator via a flow control mechanism, such as a pump or valve. The steam generator includes a heater for heating the liquid to produce steam, which can be directed towards the surface to be cleaned through a steam outlet, typically located in a foot or cleaning head that engages the surface to be cleaned during use. The steam is typically applied to the backside of a cleaning pad that is attached to the cleaning head. The steam saturates the cleaning pad, and the damp cleaning pad is wiped across the surface to be cleaned to remove dirt, debris, and other soils present on the surface.

BRIEF DESCRIPTION OF THE INVENTION

A surface cleaning apparatus, comprising a housing adapted for movement across a surface to be cleaned, a supply tank for holding a supply of liquid, a distributor for delivering fluid to the surface to be cleaned, a regulator tank fluidly coupled to the supply tank to regulate a flow of liquid from the supply tank to the distributor, the regulator tank including a chamber for holding a volume of liquid from the supply tank and a volume of air, a vent in fluid communication with ambient air for venting ambient air into the chamber, and a tank outlet in fluid communication with the distributor, and a conduit extending through the chamber and having at least one port in fluid communication with the chamber, wherein, as liquid flows out of the supply tank, the at least one port exchanges liquid and air between the chamber and the supply tank to regulate a steady flow of liquid through the outlet regardless of the volume of liquid in the supply tank.

BRIEF DESCRIPTION OF THE DRAWING(S)

DETAILED DESCRIPTION OF THE INVENTION

Figure 1:
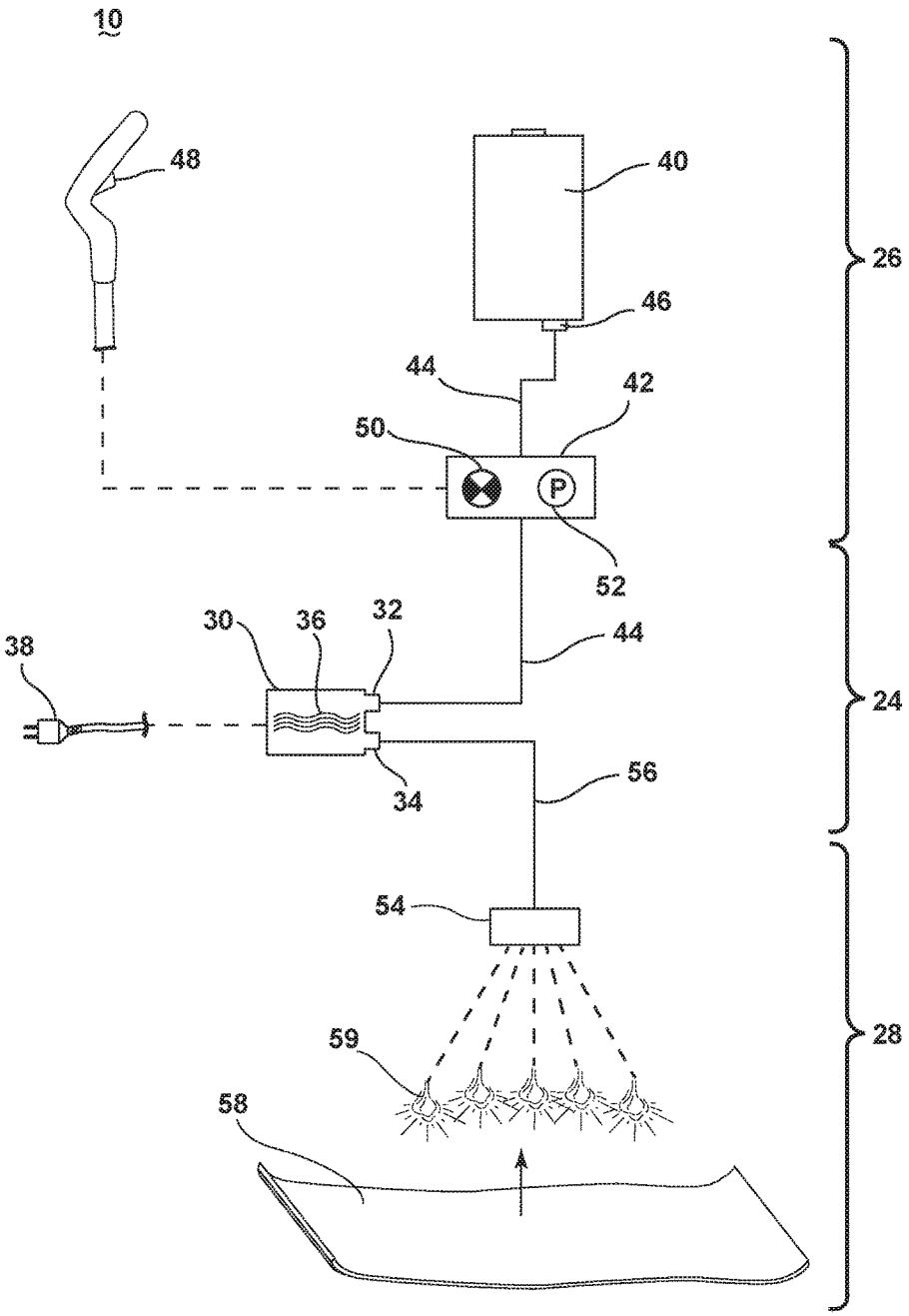
FIG. 1 is a schematic view of a surface cleaning apparatus in the exemplary form of a steam cleaning apparatus.

FIG. 1 is a schematic view of various functional systems of a surface cleaning apparatus in the form of a steam mop 10. While referred to herein as a steam mop 10, the surface cleaning apparatus can alternatively be configured to dispense steam or liquid as a hand-held applicator device, or as an apparatus having a hand-held accessory tool connected to a canister or other portable device by a fluid distribution hose. Additionally, the surface cleaning apparatus can be configured to have agitation capability, including scrubbing and/or sweeping, vacuuming capability, and/or extraction capability.

The steam mop 10 includes a steam generation system 24 for producing steam from liquid, a liquid distribution system 26 for storing liquid and delivering the liquid to the steam generation system 24, and a steam delivery system 28 for delivering steam to a surface to be cleaned.

The steam generation system 24 can include a steam generator 30 producing steam from liquid. The steam generator 30 can include an inlet 32 and an outlet 34, and a heater 36 between the inlet 32 and outlet 34 for boiling the liquid. Some non-limiting examples of steam generators 30 include, but are not limited to, a flash heater, a boiler, an immersion heater, and a flow-through steam generator. The steam generator 30 can be electrically coupled to a power source 38, such as a battery or by a power cord plugged into a household electrical outlet.

The liquid distribution system 26 can include at least one supply tank 40 for storing a supply of liquid. The liquid can comprise one or more of any suitable cleaning liquids, including, but not limited to, water, compositions, concentrated detergent, diluted detergent, etc., and mixtures thereof. For example, the liquid can comprise a mixture of water and concentrated detergent. The liquid distribution system 26 can further include multiple supply tanks, such as one tank containing water and another tank containing a cleaning agent.

The liquid distribution system 26 can comprise a flow controller 42 for controlling the flow of liquid through a fluid conduit 44 coupled between an outlet port 46 of the supply tank 40 and the inlet 32 of the steam generator 30. An actuator 48 can be provided to actuate the flow controller 42 and dispense liquid to the steam generator 30.

In one configuration, the liquid distribution system 26 can comprise a gravity-feed system and the flow controller 42 can comprise a valve 50, whereby when valve 50 is open, liquid will flow under the force of gravity, through the fluid conduit 44, to the steam generator 30. The actuator 48 can be operably coupled to the valve 50 such that pressing the actuator 48 will open the valve 50. The valve 50 can be mechanically actuated, such as by providing a push rod with one end coupled to the actuator 48 and another end in register with the valve 50, such that pressing the actuator 48 forces the push rod to open the valve 50. Alternatively, the valve 50 can be electrically actuated, such as by providing electrical switch between the valve 50 and the power source 38 that is selectively closed when the actuator 48 is actuated, thereby powering the valve 50 to move to an open position.

In another configuration, the flow controller 42 can comprise a pump 52 which distributes liquid from the supply tank 40 to the steam generator 30. The actuator 48 can be operably coupled to the pump 52 such that pressing the actuator 48 will activate the pump 52. The pump 52 can be electrically actuated, such as by providing electrical switch between the pump 52 and the power source 38 that is selectively closed when the actuator 48 is actuated, thereby activating the pump 52.

The steam delivery system 28 can include at least one steam outlet 54 for delivering steam to the surface to be cleaned, and a fluid conduit 56 coupled between an outlet 34 of the steam generator 30 and the at least one steam outlet 54. The at least one steam outlet 54 can comprise any structure, such as a perforated manifold or at least one nozzle; multiple steam outlets can also be provided. In use, the generated steam is pushed out of the outlet 34 of the steam generator 30 by pressure generated within the steam generator 30 and, optionally, by pressure generated by the pump 52. The steam flows through the fluid conduit 56, and out of the at least one steam outlet 54.

A cleaning pad 58 can be removably attached over the steam outlet 54 to the steam mop 10. In use, the cleaning pad 58 is saturated by the steam from the steam outlet 54, and the damp cleaning pad 58 is wiped across the surface to be cleaned to remove dirt present on the surface. The cleaning pad 58 can be provided with features that enhance the scrubbing action on the surface to be cleaned to help loosen dirt on the surface. The cleaning pad 58 can be disposable or reusable, and can further be provided with a cleaning agent or composition that is delivered to the surface to be cleaned along with the steam. For example, the cleaning pad 58 can comprise disposable sheets that are pre-moistened with a cleaning agent. The cleaning agent can be configured to interact with the steam, such as having at least one component that is activated or deactivated by the temperature and/or moisture of the steam. In one example, the temperature and/or moisture of the steam can act to release the cleaning agent from the cleaning pad 58.

The steam mop 10 shown in FIG. 1 can be used to effectively remove dirt (which may include dust, stains, and other debris) from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

The cleaning pad 58 is attached to the steam mop 10, over the steam outlet 54, the supply tank 40 is filled with liquid, and the steam generator 30 is coupled to the power source 38. Upon actuation of the actuator 48, liquid flows to the steam generator 30 and is heated to its boiling point to produce steam. The steam 59 exits the steam outlet 54 and passes through the cleaning pad 58. As steam passes through the cleaning pad 58, a portion of the steam may return to liquid form before reaching the floor surface. The steam delivered to the floor surface also returns to liquid form. As the damp cleaning pad 58 is wiped over the surface to be cleaned, excess liquid and dirt on the surface is absorbed by the cleaning pad 58.

Figure 2:
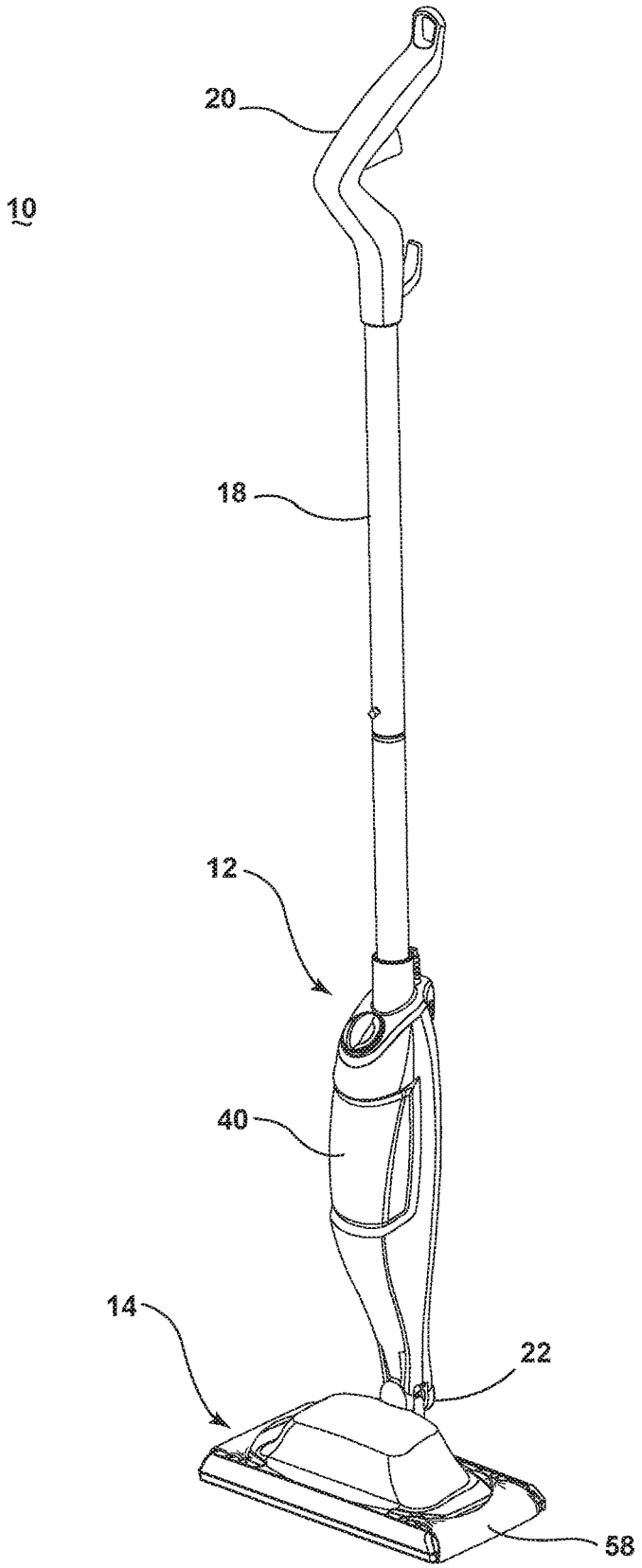
FIG. 2 is a front perspective view of a steam cleaning apparatus in the form of a steam mop according to a first embodiment of the invention.

FIG. 2 is a front perspective view of a steam cleaning apparatus in the form of a steam mop 10 according to a first embodiment of the invention. For purposes of description related to the figures, the terms "upper," "lower," "right," "left," "rear," "front," "vertical," "horizontal," "inner," "outer," and derivatives thereof shall relate to the invention as oriented in FIG. 1 from the perspective of a user behind the steam mop 10, which defines the rear of the steam mop 10. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The steam mop 10 comprises a upper housing 12 mounted to a lower cleaning foot 14 which is adapted to be moved across a surface to be cleaned. The housing 12 and the foot 14 may each support one or more components of the various functional systems discussed with respect to FIG. 1. An elongated handle 18 can project from the housing 12, with a handle grip 20 provided on the end of the handle 18 to facilitate movement of the steam mop 10 by a user. A coupling joint 22 is formed at an opposite end of the housing 12 and moveably mounts the foot 14 to the housing 12. In the embodiment shown herein, the coupling joint 22 can comprise a universal joint, such that the foot 14 can pivot about at least two axes relative to the housing 12.

Figure 3:
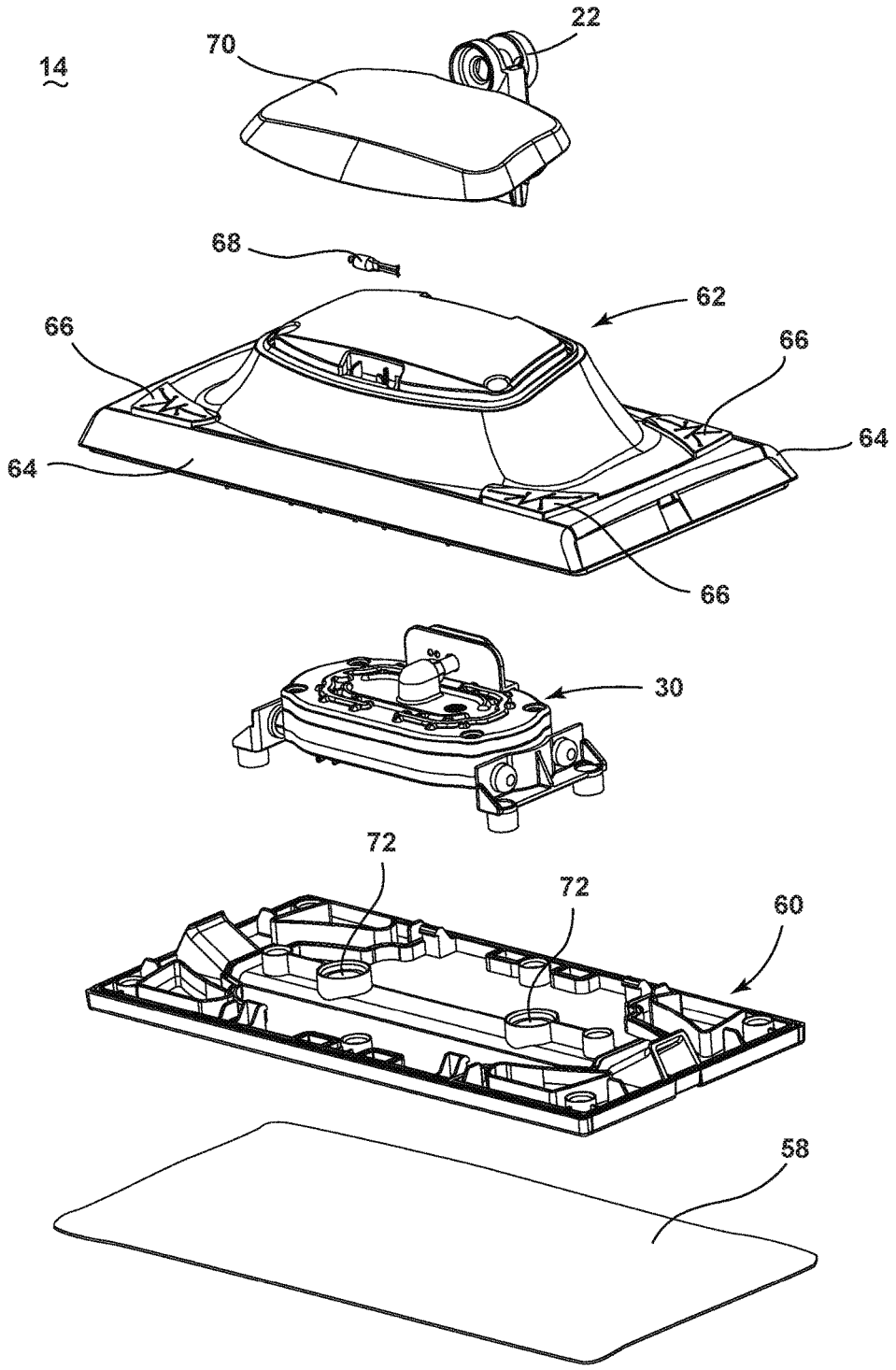
FIG. 3 is a partially exploded view of a foot assembly for the steam mop of FIG. 2.

FIG. 3 is a partially exploded view of a foot 14 that can be used with the steam mop 10 shown in FIGS. 1-2. The foot 14 can comprise a base housing adapted to be moved over the surface to be cleaned and which carries the steam generator 30 and can mount the cleaning pad 58, generally described with respect to FIG. 2. The base housing includes a base frame 60 and an upper cover 62 which together define an internal cavity in which the steam generator 30 is mounted. The cover 62 includes bumpers 64 that span the front and rear sides of the housing, which also correspond to the leading and trailing edges of the foot 14. The bumpers 64 can comprise an elastomeric, non-marring material and can be over-molded or otherwise fastened to the cover 62 of the housing. The cover 62 further includes pad retainers 66 that are configured to hold a portion of the cleaning pad 58 in register with the foot 14. The cleaning pad 58 is retained on the foot 14 by pressing the cleaning pad 58 into serrated slits formed in the deflectable pad retainers 66.

A headlight 68 can be provided in the housing for illuminating the surface to be cleaned, particularly in front of the leading edge of the foot 14. As shown herein, the headlight 68 is mounted on the upper cover 62, beneath a light cover 70. The headlight 68 can be coupled with the same power cord 38 that is attached to the steam generator 30, such that the headlight 68 will automatically turn on when the steam generator 30 is on. Alternatively, a separate switch (not shown) can be provided to selectively turn on the headlight 68.

Alternatively or additionally, the headlight 68 can be configured to provide indicia of the functional status of the steam generator 30. For example, the headlight 68 can be configured to illuminate when the steam generator 30 has reached the threshold operational temperature for generating steam. In one configuration, the headlight 68 can be electrically coupled with a thermostat (not shown) and is configured to illuminate only after the steam generator 30 reaches a predetermined operating temperature as determined by the thermostat.

Figure 4:
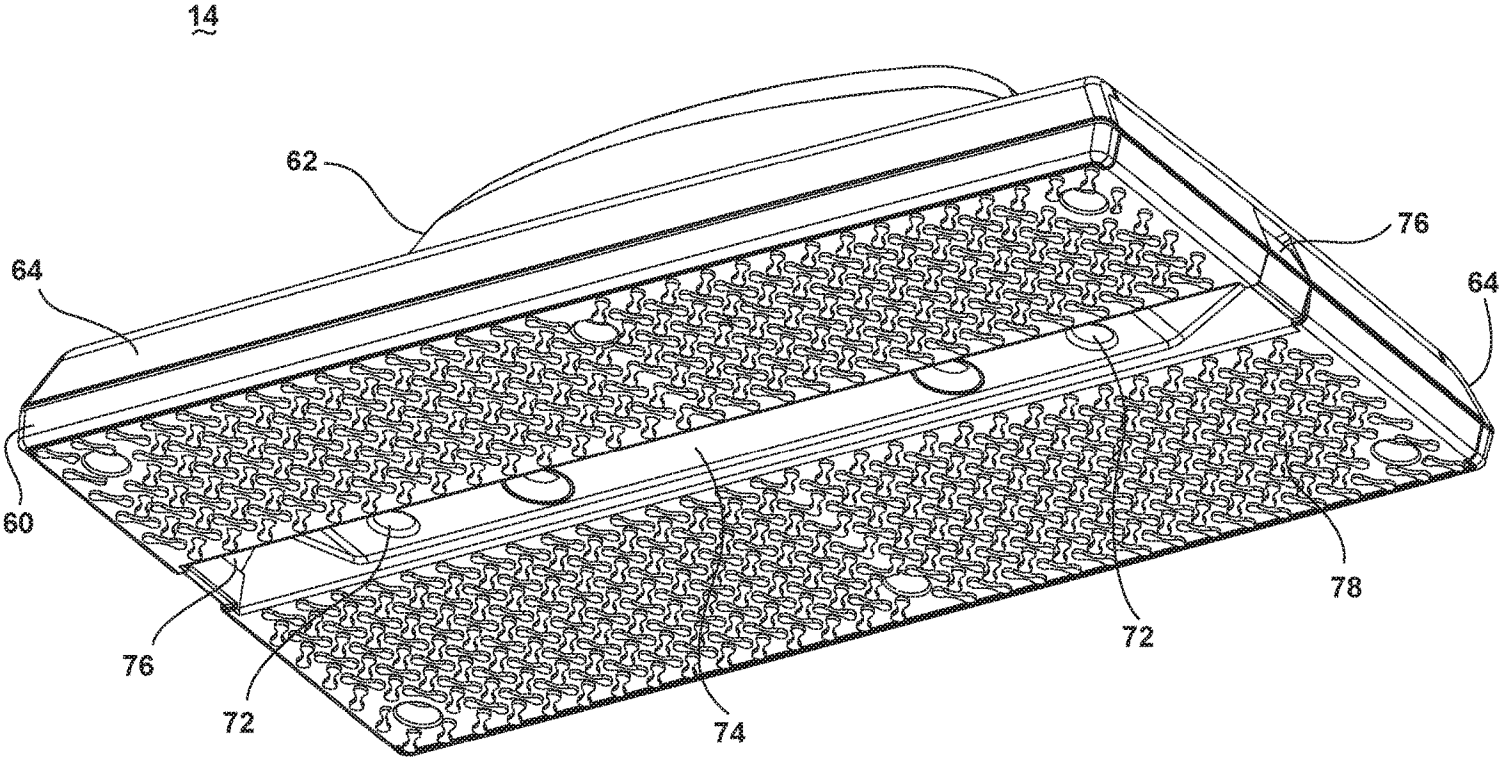
FIG. 4 is a bottom perspective view of the foot assembly from FIG. 3.

FIG. 4 is a bottom perspective view of the foot 14 from FIG. 3. The housing includes the at least one steam outlet, shown in this embodiment as two steam orifices 72 located in an open channel 74 formed in the bottom of the base frame 60. The housing is also provided with side vents 76 at the ends of the channel 74 to distribute a portion of the steam above the foot 14 so that some steam is visible to the user. This provides a visual indicator to the user that steam is being produced. A textured surface 78 can be provided on the bottom of the base frame 60 to help prevent the cleaning pad 58 from shifting relative to the housing.

Figure 5:
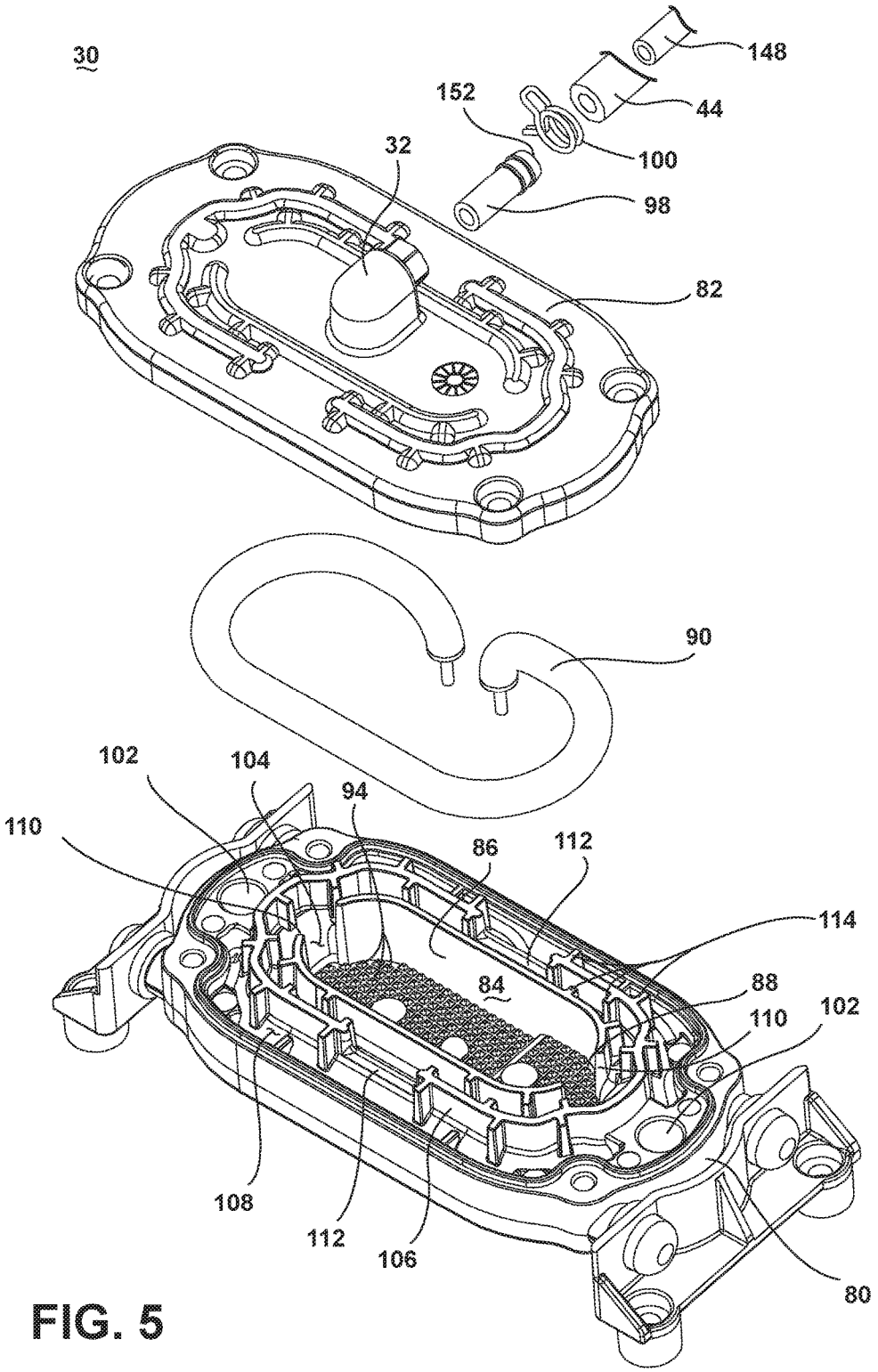
FIG. 5 is an exploded view of a steam generator of the foot assembly from FIG. 3.

FIG. 5 is an exploded view of the steam generator 30 from FIG. 3. The steam generator 30 can be used with the steam mop 10 shown in FIGS. 1-2. In this embodiment, the steam generator 30 comprises a flash heater having an open-topped heater block 80 and a heater cover 82 mounted to the heater block 80. The heater block 80 and cover 82 together define a cavity 84 having a side wall 86 and a bottom wall having a heating surface 88. An electrical heating element 90 is mounted within the heater block 80, beneath and in thermal register with the heating surface 88. A thermostat (not shown) can be connected to the heating element 90 and adapted to regulate the operational temperature of the heating element 90 based on a desired performance criteria. For example, the thermostat can regulate the operational temperature to meet the boiling point of the liquid to be converted to steam. When the steam generator 30 is energized and the heating element 90 is adapted to flash heat liquid on the heating surface 88 and convert the liquid into steam.

The heating surface 88 can be provided with a plurality of projections 94 which are adapted to increase the surface area of the heating surface 88. Alternatively, the heating surface 88 can be flat, or provided with a different texture than the one shown herein, including combinations of convex, concave or undulating formations. The heating surface 88 can further have a top layer or coating for corrosion resistance and/or friction reduction. For example, the heating surface 88 can be coated with polytetrafluoroethylene (PTFE), which will improve the dispersion of liquid over the heating surface 88 by reducing the friction between the liquid and the heating surface 88, and will also minimize the corrosion of the heating surface by minimizing the build-up of residue on the heating surface 88.

The inlet 32 to the steam generator 30 is provided in the heater cover 82, above the heating surface 88, and is fluidly connected to the conduit 44. The inlet 32 can contain an orifice restrictor 98 for limiting the flow rate of liquid into the cavity 84 of the flash heater. The conduit 44 can be coupled to the orifice restrictor 98 by a spring retainer 100.

Alternatively, the orifice restrictor 98 can be located elsewhere within the conduit 44, such as directly downstream from the valve 50, for example. In one embodiment, the inner diameter of the orifice restrictor 98 opening can be about 0.7 mm. Although a single orifice restrictor 98 is shown in the figures, multiple orifice restrictors having relatively larger openings can be stacked or connected in series to achieve the desired effective orifice opening, which renders a configuration that can be less susceptible to dimensional variances due to manufacturing inconsistency and tolerance stack-ups.

The outlet of the steam generator 30 is defined by a tortuous steam outlet pathway, which is provided in the heater block 80, and extends from the cavity 84 to orifice conduits 102 leading to the steam orifices 72 in the base frame 60 (see FIG. 3). The tortuous pathway can include an inner path 104 defined between the side wall 86 of the cavity 84 and an outer barrier wall 106 which extends substantially around the cavity side wall 86, and an outer path 108 defined between the barrier wall 106 and the heater cover 82. The entrance to the inner path 104 can be formed by slots 110 in the cavity side wall 86. Slots 112 in the barrier wall 106 similarly form the exit from the inner path 104 and the entrance to the outer path 108, and can be staggered from the inner slots 110. Both the cavity side wall 86 and the barrier wall 106 can sealingly mate with the bottom of the heater cover 82, and can include baffles 114 which project into the paths 104, 108 to increase the length of the tortuous pathway.

The steam generator 30 can generate backpressure on the upstream portion of the liquid distribution system 26. In a gravity feed liquid distribution system such as the one described herein for the first embodiment, it is preferable to limit the level of backpressure to around 0.5 inches of water (IOW) and preferably not greater than 1 IOW, to minimize the head pressure necessary to overcome the backpressure. The backpressure created within the steam generator 30 can be adjusted by changing various design parameters of the steam generator 30, such as increasing the size or quantity of the steam orifices 72, orifice conduits 102, and inner slots 110 or outer slots 112, for example.

Figure 6:
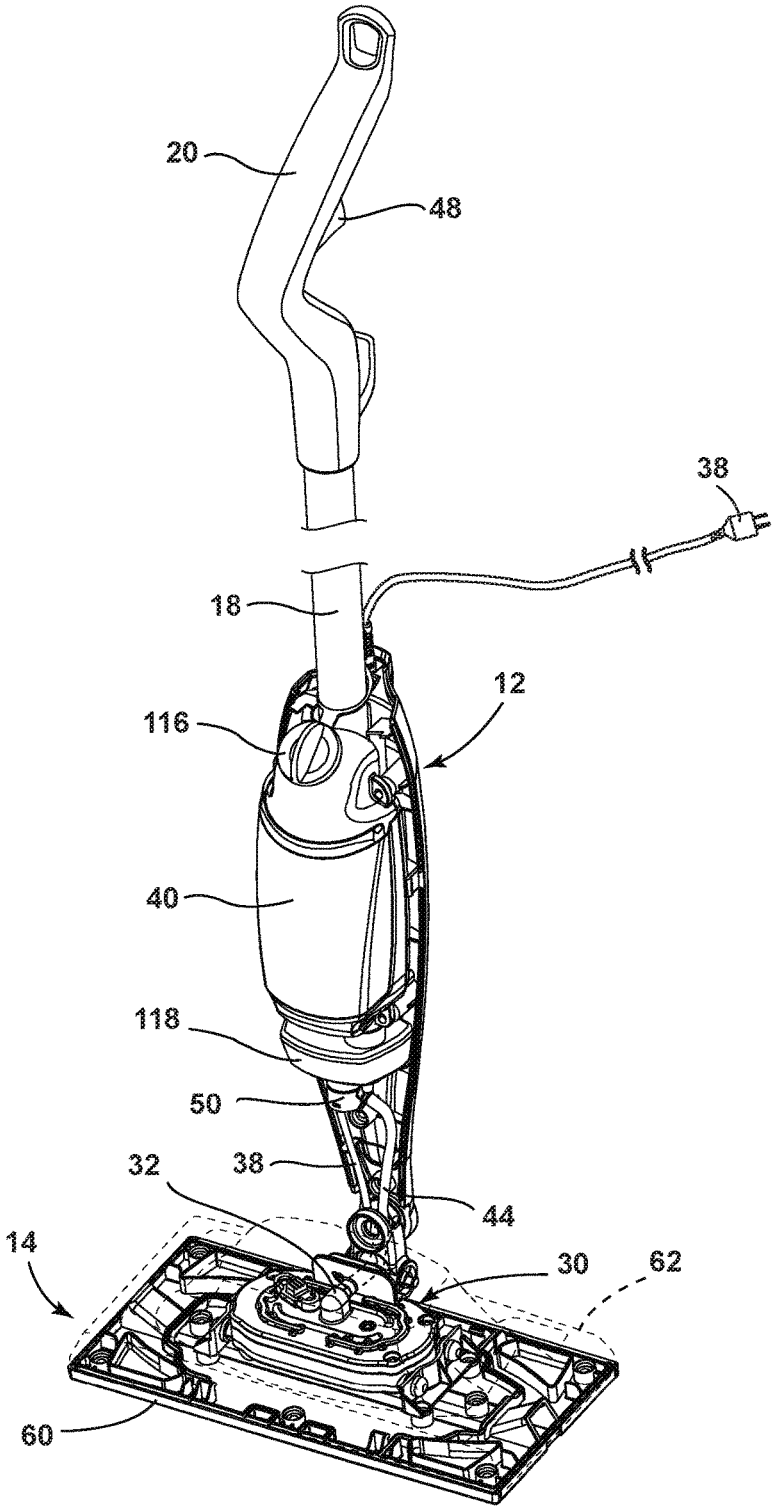
FIG. 6 is a perspective view of the steam mop of FIG. 2, with portions removed to illustrate a liquid distribution system.

FIG. 6 is a perspective view of the steam mop 10 with portions removed to illustrate a liquid distribution system 26. The liquid distribution system 26 can be used with the steam mop 10 shown in FIGS. 1-2. The liquid distribution system 26 can comprise a gravity-feed system, which includes the supply tank 40 and valve 50 described with respect to FIG. 2. In this embodiment, the power source 38 comprises a power cord 38 attached to the steam generator 30 and configured to be coupled to a household outlet.

The supply tank 40 receives a supply of liquid and has a fill opening that is selectively closed by a removable fill cap 116. In the illustrated embodiment, the supply tank 40 is provided on the housing 12, and is not removable therefrom by the user for refilling. In other embodiments, the supply tank 40 can be removable from the housing 12 for refilling. In yet another embodiment, the supply tank 40 can be removable from the housing 12, but can be disposable; in this case, when the supply tank 40 is empty, the used supply tank 40 is removed and a new, full supply tank 40 is attached to the housing 12. It is also contemplated that the supply tank 40 can be mounted to the foot 14.

The liquid distribution system 26 of this embodiment further includes a secondary regulator tank 118 in addition to the supply tank 40. The regulator tank 118 is fluidly coupled between the supply tank 40 and the steam generator 30 to maintain a constant flow of liquid via gravity feed, regardless of how full or empty the supply tank 40 is. When the fill cap 116 is attached to the supply tank 40, the supply tank 40 is essentially sealed, such that no air can enter the supply tank 40 via the fill opening. The regulator tank 118 controls the entry of air and the exit of liquid to/from the supply tank 40. The fluid conduit 44 is coupled between the regulator tank 118 and the steam generator 30.

In this embodiment, the valve 50 is provided in the housing 12, below both tanks 40, 118, to meter or control the flow of liquid to the steam generator 30. The valve 50 can be positioned in the flow path of the fluid conduit 44 connecting the regulator tank 118 to the steam generator 30. In one example, the valve 50 can comprise a mechanical plunger valve. The plunger valve can be actuated by a push rod (not shown) in register with the actuator, shown herein as a trigger 48. The trigger 48 can conveniently be provided on the handle grip 20 of the handle 18. When the plunger valve 50 is opened by squeezing the trigger 48, liquid flows by gravity to the steam generator 30.

Figure 7:
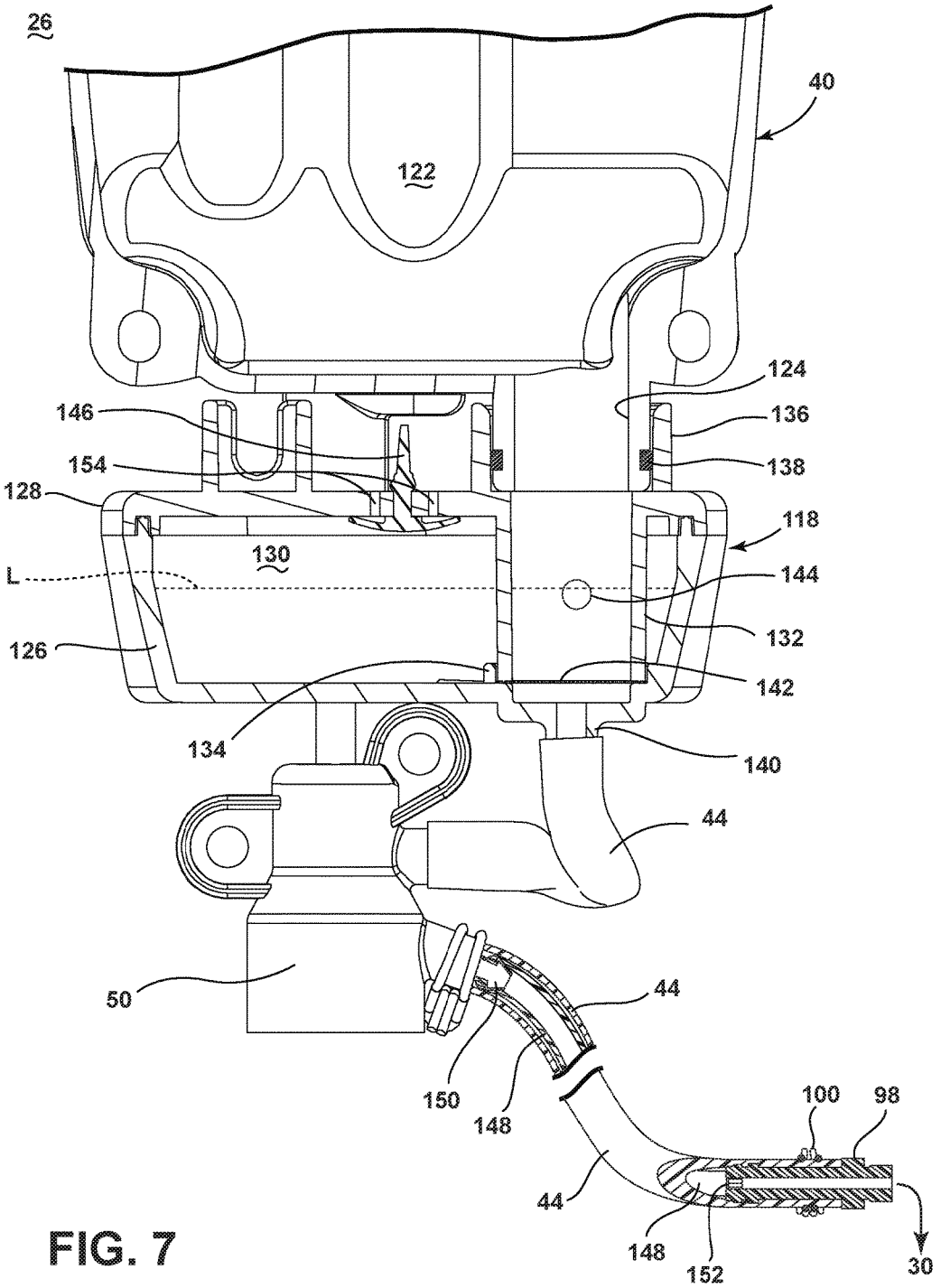
FIG. 7 is a close-up, sectional view of a portion of the liquid distribution system of FIG. 6.

FIG. 7 is a close-up, sectional view of a portion of the liquid distribution system 26. The supply tank 40 defines a chamber 122 for receiving a supply of liquid. An outlet port 124 is provided at a lower end of the supply tank 40 and fluidly connects the chamber 122 with the regulator tank 118. The regulator tank 118 includes a lower tank body 126 and a tank cover 128 which together defines a chamber 130 for receiving a supply of liquid. A conduit 132 extends through the tank 118, from the bottom of the tank body 126 to the tank cover 128. As shown herein, the conduit 132 can be formed with the tank cover 128, with the free end of the conduit 132 received in a seat 134 formed on the tank body 126, but it is also contemplated that the positions of the conduit 132 and seat 134 can be reversed, or that the conduit 132 can be formed separately of both the tank body 126 and cover 128. In one configuration, the cover 128 can be permanently fastened to the tank body 126 to form a water and air tight seal at the joint between the cover 128 and tank body 126. A variety of manufacturing processes can be utilized to fasten the cover 128 to the tank body 126 such as adhesive, ultrasonic welding or hot plate welding, for example. Alternatively, the cover 128 can be removably fastened to the tank body 126 by mechanical fasteners, snaps or latches (not shown), for example.

An upper end of the conduit 132 is in fluid communication with an outlet receiver 136 formed on the tank cover 128. The outlet receiver 136 is configured to seat the outlet port 124 on the supply tank 40. A gasket 138 can be provided between the outlet receiver 136 and the outlet port 124 in order to seal the connection between the regulator tank 118 and the supply tank 40. A lower end of the conduit 132 is in fluid communication with an outlet port 140 formed on the tank body 126. The outlet port 140 is configured to couple with an end of the fluid conduit 44.

The fluid conduit 44 can comprise flexible tubing. In one configuration, the fluid conduit 44 can comprise flexible silicone, polyurethane or polyvinyl chloride tubing, for example. The fluid conduit 44 can be treated with a coating, such as silicone, to minimize aqueous surface tension between the conduit 44 and liquid flowing therethrough, which can ultimately prevent the liquid from beading and prevent air bubbles from sticking to the inner surface of the conduit 44. Aqueous surface tension is measured as the energy required to increase the surface area of a liquid by a unit of area. Additionally, the fluid conduit 44 can be treated with an antimicrobial additive, such as Microban®, for example, to prevent the growth of biofilm within the conduit 44, which can further obstruct the conduit 44 and alter the aqueous surface tension therein.

An inner tube 148 is inserted within the portion of the fluid conduit 44 between an outlet 150 of the valve 50 and an inlet 152 to the orifice restrictor 98. The inner tube 148 reduces the cross-sectional area and volume of the liquid flow path between the valve 50 and orifice restrictor 98 and thus limits the size and tendency of air bubbles to form within the fluid conduit 44 and inner tube 148. Air bubbles within the fluid conduit 44 can cause irregular liquid flow rates that adversely affect the performance of the steam mop 10. The inner tube 148 can comprise flexible silicone, polyurethane or polyvinyl chloride tubing, for example and can be a different material or the same material as the conduit 44. In one configuration, the fluid conduit 44 comprises an inner diameter of about 4 millimeters (mm) whereas the inner tube 148 comprises an inner diameter between 1 and 2 mm and preferably about 2 mm.

A filter 142 can be provided in the flow conduit 132 for filtering the liquid passing out of the regulator tank 118. As shown herein, the filter 142 is fixed within the seat 134 on the tank body 126. The filter 142 can be configured to prevent foreign particulates and debris from entering the steam generator 30. The filter 142 can comprise a screen or mesh structure with openings sized to block particles of a predetermined size. In one configuration, the diameter of the mesh openings is about 0.2 millimeters. The material forming the filter 142 is preferably resistant to various cleaning agents. Some non-limiting examples of suitable filter materials comprise polypropylene, nylon, polyester and stainless steel, for example. The filter 142 can also be treated to prevent premature clogging and to reduce the aqueous surface tension thereof. For example, the filter 142 can be formed from a thermoplastic material having an antimicrobial additive or coating, such as Microban®, for example, to prevent the growth of biofilm on the filter 142, which can clog the filter openings and reduce the effective liquid flow rate therethrough. Alternatively, or in combination, the filter 142 can comprise an additive or coating that is configured to reduce aqueous surface tension between the filter 142 and liquid passing therethrough, such as a silicone or fluorosurfactant, for example.

The interior of the conduit 132 is substantially isolated from the chamber 130, except for a relatively small air/liquid exchange port 144 provided in a side of the conduit 132. Although the air/liquid exchange port 144 has been illustrated as a single aperture, other configurations are contemplated, such as one or more apertures formed in the side or bottom edge of the conduit 132. Alternatively, the conduit 132 can terminate short of the bottom of the chamber 130, thus forming a port 144 to facilitate the exchange of liquid and air at the lower edge of the conduit 132. The air/liquid exchange port 144 is in communication with the supply tank 40 through the conduit 132, and permits the exchange of air and liquid between the chamber 122 of the supply tank 40 and the chamber 130 of the regulator tank 118. The diameter of the exchange port 144 can be relatively small in comparison to the diameter of the conduit 132. The ratio of the diameters of the exchange port 144 to the conduit 132 can be on the order of about 1:6 to about 1:4. In one configuration, the diameter of the exchange port 144 is about 2.5 mm, while the diameter of the conduit 132 is about 12.5 mm.

During use, upon filling the supply tank 40, a small volume of liquid initially flows from the supply tank 40 into the regulator tank 118 through the exchange port 144 because the head pressure of the liquid within the conduit 132 exceeds the pressure within the chamber 130. At the same time, air within chamber 130 is compressed and displaced by the liquid, and flows from the regulator tank 118 into the supply tank 40 through the exchange port 144. The liquid fills the regulator tank 118 until the pressure within the conduit 132 and chamber 130 equalizes. This pressure equalization typically occurs when the liquid level, indicated by line L, falls within the area of the exchange port 144. As shown herein, the liquid level L is slightly below the top of the air/liquid exchange port 144. However, in some instances, the liquid will fill the regulator tank 118 to a level below, at the bottom, at the mid-level, at the top or even above the exchange port 144, depending on parameters such as the orientation of the regulator tank 118, the relative liquid fill levels of chambers 122 and 130, and the surface tension at the exchange port 144. For example, the orientation of the regulator tank 118 can affect the fill level L such as when the handle 18 and upper housing 12 are reclined relative to vertical. In that case, additional liquid may flow through the exchange port 144 into the regulator tank 118 so that the liquid fill level L may lie above the exchange port 144 when the handle 18 is returned to the vertical, storage position. Similarly, removing the fill cap 116 can cause additional liquid to flow through the exchange port 144 because the effective pressure on the exchange port 144 from within the conduit 132 will be higher and more apt to overcome the surface tension of the exchange port 144. In all instances, however, a volume of air will remain in the regulator tank 118 and will occupy the portion of the chamber 130 above line L.

The regulator tank 118 can further include a vent in fluid communication with ambient air for venting ambient air into the chamber 130. The vent can be directly provided on the regulator tank 118, or can be remote from the regulator tank 118 but in fluid communication with the chamber 130 in order to vent ambient air into the chamber 130. As illustrated the vent includes at least one vent hole 154 in a wall of the regulator tank 118. The vent can further include an air entry valve 146 provided in the regulator tank 118 to control the venting of ambient surrounding air into the regulator tank 118 through the at least one vent hole 154 to maintain equalized pressure between the conduit 132 and chamber 130 when fluid is dispensed from the supply tank 40. When the valve 50 is opened, the combined head pressure of liquid within the chamber 122 and conduit 132 forces liquid through the downstream conduit 44. However, because the supply tank 40 is sealed by the fill cap 116, a vacuum is created within the air space above the liquid in the chamber 122. That vacuum also induces a negative pressure inside the chamber 130, through the exchange port 144. When the negative pressure in the chamber 130 is greater than the cracking pressure of the air entry valve 146, the air entry valve 146 opens by deforming downwardly to expose vent holes 154, which permit ambient surrounding air to pass into the chamber 130 into the portion above the liquid at line L. When the negative pressure in the chamber 130 overcomes the surface tension of liquid around the exchange port 144 inside the chamber 130, the incoming vent air flows through the exchange port 144 and into the supply tank 40, thereby venting and metering the amount of liquid that is dispensed from the supply tank 40. In one example, the air entry valve 146 can be seated over multiple vent holes 154 formed in the tank cover 128 and can comprise an umbrella valve configured to open at a predetermined cracking pressure. In one configuration, the cracking pressure is approximately 0.5 inches of water (IOW).

If the liquid level in the regulator tank 118 covers the exchange port 144, further exchange of liquid and air between the tanks 40, 118 is generally prevented, since the supply tank 40 is now fully sealed. In this case, when the valve 50 is opened, the head pressure of liquid in the supply tank 40 forces liquid within the conduit 132 downwardly through the conduit 44, which induces a vacuum within the air space above the liquid in the chamber 122. That vacuum can also induce a negative pressure inside the conduit 132. Because the regulator tank 118 is configured to equalize pressure between chamber 130 and conduit 132, liquid from the chamber 130 is drawn through the exchange port 144 into the conduit 132. As liquid is dispensed from the conduit 132, the level of liquid in the regulator tank 118 drops to uncover the exchange port 144, which once again allows exchange of air between the tanks 40, 118 to resume. Accordingly, vent air can once again be drawn in through the air entry valve 146, through the exchange port 144 and into the supply tank 40 to effectively vent the supply tank 40 and meter the amount of liquid that is dispensed from the supply tank 40. Thus, regardless of whether the exchange port 144 is open or covered by liquid, a steady flow of liquid through the liquid distribution system 26 is provided.

The liquid distribution system 26, including the regulator tank 118, is configured to equalize pressure between chamber 130 and conduit 132 in a cyclic, controlled manner during use. The pressure equalization can be affected by several variables, including the liquid level inside the regulator tank 118 at line L and the volume of air inside the regulator tank 118 above line L, the liquid fill level inside chamber 122, and surface tension around the exchange port 144 due to liquid within the conduit 132. The liquid distribution system 26 is designed to maintain a substantially consistent liquid level and air volume within the regulator tank 118, which helps to ensure a controlled equalization of pressure between the chamber 130 and conduit 132, and which subsequently limits the volume of vented air that can pass into the regulator tank 118 and upstream supply tank 40, and thus effectively meters a steady flow of liquid at a substantially constant flow rate.

The exchange of liquid and air between the tanks 40, 118 also serves as an indicator to the user that the liquid distribution system 26 is functioning properly and providing liquid to the steam generator 30. Air flowing into the supply tank 40 from the regulator tank 118 creates bubbles in the supply tank 40, which acts as a signal the user can see and/or hear to know that liquid is being distributed.

The steam mop 10 shown in FIGS. 2-7 can be used to effectively remove dirt (which may include dust, stains, and other debris) from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

In operation, the cleaning pad 58 is attached to the foot 14, the supply tank 40 is filled with liquid, and the power cord 38 is plugged into a household electrical outlet. Upon pressing the trigger 48, the valve 50 is opened and liquid flows from the supply tank 40 and the regulator tank 118 to the steam generator 30. As liquid is distributed to the steam generator 30, air is exchanged between the regulator tank 118 and the supply tank 40 according to the process described above with respect to FIGS. 6-7, which meters the amount of liquid that is dispensed from the supply tank 40. Thus, a steady flow of liquid is provided to the steam generator 30 as long as the valve 50 is open. In the steam generator 30, liquid is heated to its boiling point to produce steam by flashing off the heating surface 88. The generated steam is pushed out from the steam generator 30 and guided downwardly through the steam orifices 72 in the foot 14 towards the surface to be cleaned. As steam passes through the cleaning pad 58, a portion of the steam may return to liquid form before reaching the floor surface. The steam delivered to the floor surface also returns to liquid form. As the damp cleaning pad 58 is wiped over the surface to be cleaned, excess liquid and dirt on the surface is absorbed by the cleaning pad 58.

The surface cleaning apparatus disclosed herein provides an improved cleaning operation. One advantage that may be realized in the practice of some embodiments of the described surface cleaning apparatus is that pressure within the regulator tank 118 is equalized in a controlled, cyclic manner, which results in a substantially steady flow of liquid out of the supply tank 40. Gravity-feed systems, whether the apparatus ultimately dispenses steam or liquid to the surface, are prone to flow rate issues. In gravity-feed systems, gravity is used to move the liquid out of the supply tank, and is typically applied by placing the supply tank above the fluid distributor and optionally the steam generator. Therefore, the amount of liquid in the supply tank affects the flow rate of liquid out of the supply tank. As liquid is dispensed, the amount of liquid in the supply tank necessarily decreases, which results in a decreased flow rate. Gravity-feed systems may also be negatively impacted by surface tension in the flow path downstream of the supply tank, air bubbles on the wall of the flow path, dimensional variations between components used for the flow path, and/or back pressure from the optionally steam generator. The surface cleaning apparatus described herein avoids these issues and provides a liquid distribution system that can maintain a constant flow of liquid via gravity feed, regardless of the amount of liquid supply tank. The liquid distribution system utilizes a downstream regulator tank that controls the entry of air and the exit of liquid to/from the supply tank. While shown herein as being applied to a steam mop 10, the invention is suited for any steam or liquid cleaning device that requires a relatively low flow rate of fluid.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A surface cleaning apparatus, comprising:

a housing adapted for movement across a surface to be cleaned;

a supply tank for holding a supply of liquid;

a distributor for delivering fluid to the surface to be cleaned;

a regulator tank fluidly coupled to the supply tank to regulate a flow of liquid from the supply tank to the distributor, the regulator tank comprising:

a chamber for holding a volume of liquid from the supply tank and a volume of air;

a vent in fluid communication with ambient air for venting ambient air into the chamber; and a tank outlet in fluid communication with the distributor;

a conduit extending through the chamber of the regulator tank and having an inlet end in fluid communication with the supply tank and an outlet end in fluid communication with the tank outlet; and at least one port provided in the conduit between the inlet end and outlet ends of the conduit;

wherein the at least one port is in fluid communication with the chamber and the conduit is fluidly isolated from the chamber save for the at least one port and wherein as liquid flows out of the supply tank, the at least one port exchanges liquid and air between the chamber and the supply tank to regulate a steady flow of liquid through the outlet regardless of the volume of liquid in the supply tank.

2. The surface cleaning apparatus of claim 1 wherein the conduit extends through the chamber from the supply tank to the tank outlet.

3. The surface cleaning apparatus of claim 1 wherein the supply tank is positioned above the regulator tank such that liquid flows out of the supply tank by gravity feed.

4. The surface cleaning apparatus of claim 1 wherein the supply tank is positioned above the conduit such that liquid flows into the conduit from the supply tank by gravity feed.

5. The surface cleaning apparatus of claim 1 wherein the supply tank comprises a supply tank outlet in fluid communication with the inlet end of the conduit.

6. The surface cleaning apparatus of claim 1 wherein the vent comprises a valve controlling venting of ambient air into the chamber.

7. The surface cleaning apparatus of claim 6, wherein the valve comprises an umbrella valve provided on a wall of the regulator tank.

8. The surface cleaning apparatus of claim 1, further comprising a tubing coupled with the tank outlet, wherein the tubing comprises a coating for minimizing aqueous surface tension between the tubing and a liquid flowing through the tubing.

9. The surface cleaning apparatus of claim 8, wherein the tubing is further treated with an antimicrobial additive.

10. The surface cleaning apparatus of claim 1, further comprising a control valve in fluid communication with the tank outlet to control the flow of liquid out of the supply tank.

11. The surface cleaning apparatus of claim 10 wherein the control valve is provided below the supply tank and regulator tanks such that liquid flows out of the supply tank by gravity feed.

12. The surface cleaning apparatus of claim 1, further comprising a filter provided in the conduit.

13. The surface cleaning apparatus of claim 1 wherein the housing comprises:

a base housing adapted for movement across the surface to be cleaned; and an upper housing provided on the base housing and comprising a handle to facilitate movement of the base housing across the surface to be cleaned;

wherein the distributor is provided on the base housing.

14. The surface cleaning apparatus of claim 13, wherein and the supply tank and the regulator tank are provided on the upper housing.

15. The surface cleaning apparatus of claim 13, and further comprising a cleaning pad attached to the base housing, wherein the distributor is positioned to deliver fluid to the cleaning pad.

16. The surface cleaning apparatus of claim 13, and further comprising:

a flow controller operable to control the flow of liquid out of the supply tank; and a trigger provided on the handle and operably coupled with the flow controller.

* * * * *